United States Patent [19]

Husges

[11] 4,049,215

[45] Sept. 20, 1977

[54] FLYER BOBBIN

[75] Inventor: Gerd Husges, Ingolstadt, Germany

[73] Assignee: Schubert & Salzer Maschinenfabrik Aktiengesellschaft, Germany

[21] Appl. No.: 705,772

[22] Filed: July 16, 1976

[30] Foreign Application Priority Data

July 24, 1975 Germany ..... 7523559[U]

[51] Int. Cl.[2] ..... B65H 75/28

[52] U.S. Cl. ..... 242/125.1

[58] Field of Search ..... 242/125.1, 125.2, 18 PW, 242/18 EW; 57/52, 34 TT

[56] References Cited

U.S. PATENT DOCUMENTS

| | | | |
|---|---|---|---|
| 2,614,771 | 10/1952 | Goodhue | 242/125.1 |
| 2,987,267 | 6/1961 | Hayes et al. | 242/125.1 |
| 3,051,411 | 8/1962 | Atwood et al. | 242/125.1 |
| 3,814,347 | 6/1974 | Moren, Jr. | 242/125.1 |

FOREIGN PATENT DOCUMENTS

| | | | |
|---|---|---|---|
| 585,734 | 2/1947 | United Kingdom | 242/125.1 |

*Primary Examiner*—George F. Mautz

*Attorney, Agent, or Firm*—Bailey, Dority & Flint

[57] ABSTRACT

A flyer bobbin for receiving roving having an elongated cylindrical barrel with a longitudinal groove provided in the surface thereof. An elongated resilient clamp member is carried within the groove with one end secured in the groove and the other end extending therefrom. A flat area is provided on the surface of the bobbin directly adjacent one end of the groove directly under the outwardly extending portion of the resilient member. A similar resilient clamp member and groove is provided on the opposite side of the barrel. Thus, by using two clamp members, one of them always faces the service side of the machine.

2 Claims, 3 Drawing Figures

FLYER BOBBIN

BACKGROUND OF THE INVENTION

Before the beginning of each windup process, the roving end must be fastened to the periphery of an empty flyer bobbin. This is usually effected by the operator manually placing several turns of roving on the bobbin, with cross-over of at least the starting position. This procedure is time consuming and prolongs the down time of the machine. Flyer bobbins with an adhesive band (U.S. Pat. No. 3,380,238) make possible a more rapid fastening of the roving ends; however, the adhesive then relatively quickly fills up with the fibers and must be frequently cleaned if it is to remain functional.

SUMMARY OF THE INVENTION

The invention includes a flyer bobbin for receiving roving. The bobbin includes an elongated cylindrical barrel having a longitudinally extending groove provided in the surface thereof. A flat area is provided on the surface of the bobbin directly adjacent one end of the groove. An elongated resilient member is secured to the barrel in the groove with one end thereof extending outwardly therefrom over then flattened portion. An end of the roving can be forced between the resilient member and the barrel for securing the roving to the barrel in order to initiate the winding of the roving thereon.

Another similar resilient member may be provided on the other side of the bobbin so that a clamp element always faces the service side of the machine.

Accordingly, it is an important object of the invention to provide a convenient fastening means for flyer bobbins for holding the end of roving when starting the winding on the bobbin.

Another important object of the present invention is to provide a clamp for securing the end of roving to a bobbin which resiliently abuts the periphery of the bobbin body.

Still another important object of the present invention is to provide a clamp adjacent the end of a bobbin having a flattened portion directly thereunder which provides access to the clamp.

These and other objects and advantages of the invention will become apparent upon reference to the following specification, attendant claims and drawing.

DESCRIPTION OF A PREFERRED EMBODIMENT

Figure 1:
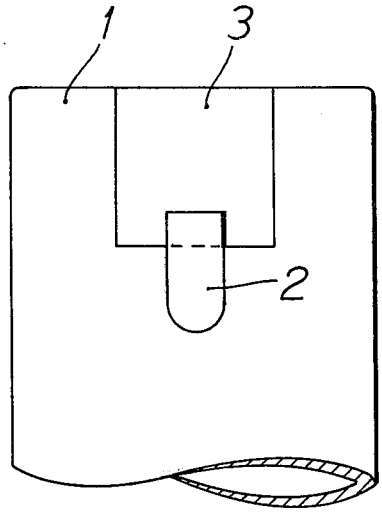
FIG. 1 is a front elevational view illustrating a top portion of a bobbin constructed in accordance with the present invention.
Figure 2:
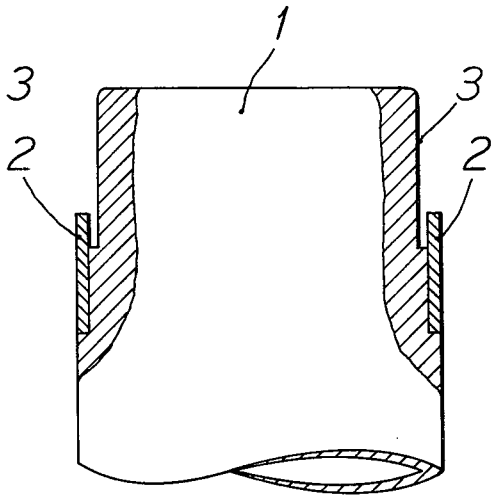
FIG. 2 is a side elevational view of the bobbin on FIG. 1 with parts illustrated in section.

Referring in more detail to FIGS. 1 and 2 of the drawing there is illustrated a resilient member in the form of a clamp element 2 fitted at an upper end of the bobbin 1. The clamp element 2 has the shape of a long, flat tongue which lies in a groove provided in the bobbin body so that the clamp element is integral with the surface of the bobbin.

One end of the tongue is attached to the bobbin body by any suitable means and the other end extends in the direction of the longitudinal axis of the bobbin 1 and resiliently abuts against the periphery of the bobbin. The resilient action of the clamp element 2 derives from the elastic plastics from which it is made. It can, however, also be made of spring steel. A flattened area 3 is appropriately provided on the bobbin body at the height of the free end of the clamp element 2, so that this end makes no contact with the bobbin 1 and the clamping point is freely accessible. The roving end thus can be pushed by the operator, without time consuming manipulations of the clamp element, between the outer end of the clamp 2 and the flattened portion 3 on the bobbin body. This causes the part of the clamp element extending over the flattened portion 3 to spread slightly away from the bobbin 1 and presses the roving resiliently against the surface of the bobbin. Thus, the roving end is fastened securely.

The roving is first wound onto the bobbin 1 in the direction towards the top of the bobbin, so that a layer of roving is made around the upper end of the clamp element and then downward in the direction towards the bobbin foot. As can be seen in FIG. 2, two clamp elements 2 are fitted to the bobbin 1 and lie opposite each other. This has the advantage as against a single clamp element in that in any given placing of the bobbin 1, a clamp element 2 always faces the service side of the machine.

The clamp element 2 can, of course, also be attached to any other place of the bobbin periphery according to where winding up of the roving is to commence. Likewise, the number of clamp elements can be increased and the arrangement be such that the free end of the clamp element 2 points, not toward the bobbin head, but towards the middle of the bobbin. The clamp element may also be also be aligned in the peripheral direction of the bobbin 1.

Figure 3:
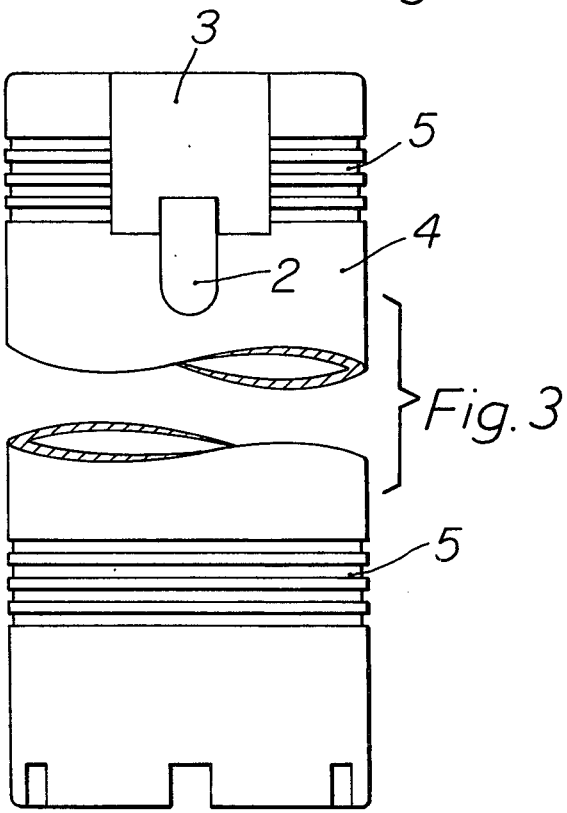
FIG. 3 is a front elevational view of another type of bobbin constructed in accordance with the present invention.

In FIG. 3 the clamp element is fitted near the head of a bobbin 4 with grooves 5 provided therein. The flattened area 3 on the bobbin body, which facilitates access to the clamping point, here extends over the grooves 5 on the head of the bobbin 4.

While a preferred embodiment of the invention has been described using specific terms, such description is for illustrative purposes only, and it is to be understood that changes and variations may be made without departing from the spirit or scope of the following claims.

What is claimed is:

1. A flyer bobbin for receiving roving comprising:
   - an elongated cylindrical barrel;
   - a longitudinally extending groove provided in the surface of said barrel;
   - an elongated resilient clamping member having one end secured to said barrel in said groove and the other end extending therefrom;
   - a flattened area on the surface of said barrel directly adjacent one end of said groove directly under said other end of said resilient clamping member.
   - said one end of said resilient clamping member being substantially flush with the periphery of said barrel so as not to interfere with the winding of roving on said barrel; and
   - said end of said roving being secured between said flattened area on said barrel and said other end of said resilient clamping member for holding sand roving against said barrel in order to initiate the winding of said roving thereon.

2. The flyer bobbin as set forth in claim 1 further comprising:

a second longitudinally extending groove provided in the surface of said barrel circumferentially spaced approximately 180° from said other groove; and a second elongated resilient clamping member having one end secured to said barrel in said second groove and the other end extending therefrom.

* * * * *